United States Patent [19]

Kassza et al.

[11] Patent Number: 4,576,025

[45] Date of Patent: Mar. 18, 1986

[54] MAGNETIC LOCK INSERT FOR LOCK MECHANISMS

[75] Inventors: Tibor Kassza; Gyula Kákonyi, both of Budapest; Gábor Molnár, Sátoraljaujhely, all of Hungary

[73] Assignee: ELZETT Muvek, Budapest, Hungary

[21] Appl. No.: 562,713

[22] Filed: Dec. 19, 1983

[30] Foreign Application Priority Data

Jul. 6, 1983 [HU] Hungary ..... 2427/83

[51] Int. Cl.[4] ..... E05B 47/00

[52] U.S. Cl. ..... 70/276; 70/337; 70/413

[58] Field of Search ..... 70/276, 337, 340, 342, 70/413

[56] References Cited

U.S. PATENT DOCUMENTS 3,935,720 2/1976 Boving ..... 70/276

*Primary Examiner*—Robert L. Wolfe

*Attorney, Agent, or Firm*—Handal & Morofsky

[57] ABSTRACT

Two control rings (29*a*, 29*b*) are arranged between the cylinder (2) and lock body (1) which are provided with latch grooves (9) receiving that part of the latch (8) which prevents cylinder (2) rotating. The rotor housing has a latch channel (11) formed along the chord of the magnetic body (5) in the rotor (6) and can receive the other part of the latch (8) in a state of magnetic equilibrium determined by the magnets in the key (3) and the magnetic body (5). When a proper key (3) is fitted into the keyhole (10), the latch channel (11) is arranged partly in the rotor (6) housing and partly in the rotor support (4): in this position the cylinder is freely rotatable. When the proper key (3) is removed, the latch channel (11) in the rotor housing is outside the line of action of the latch (8), the latch (8) being arranged in the rotor support (4) and in the latch grooves (9) of the control rings (29*a*, 29*b*). The latch groove (33) assuring the locking position of the latches (8) is formed in the lock body (1) along the line of the latch grooves (9) of the control rings (29*a*, 29*b*).

7 Claims, 20 Drawing Figures

B–B

B-B

D–D

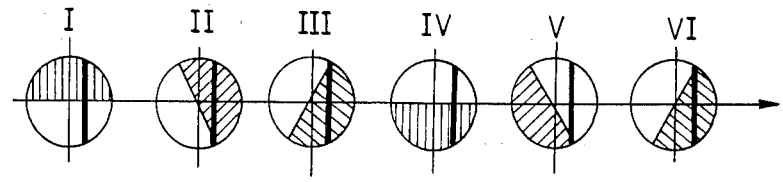
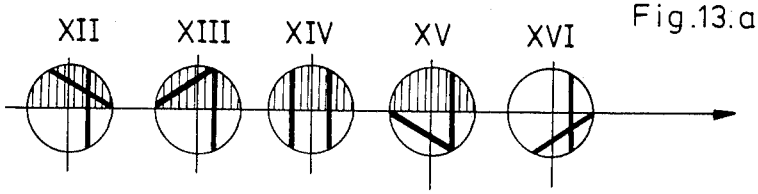
Fig.13.a
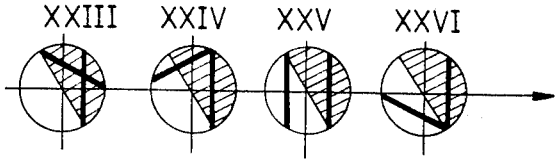
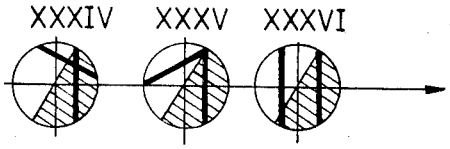
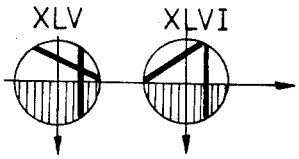
Fig.13.b
| I | II | III |
|---|---|---|
| XII<br>XIII<br>⋮ | XXIII | XXXIV |
| XII<br>XIII<br>XIV | XXIV | XXXIV |
Fig. 13.c

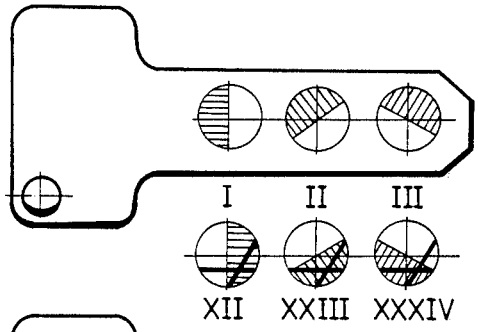
Fig.14.a
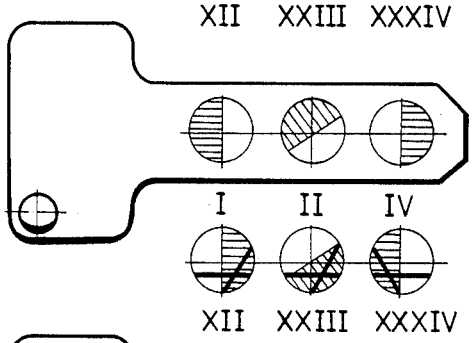
Fig.14.b
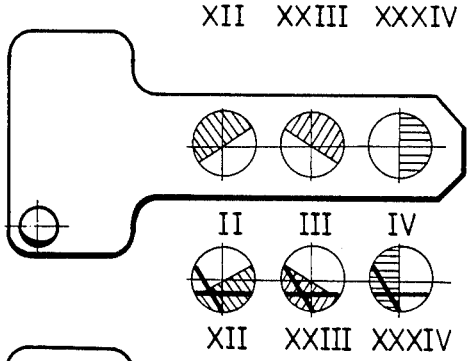
Fig.14.c
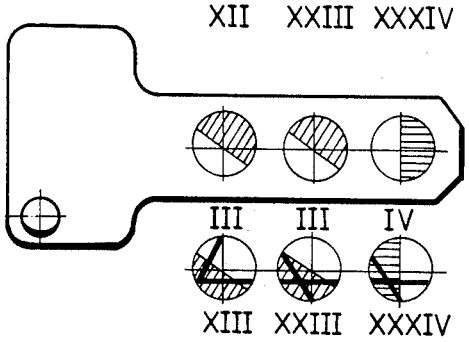
Fig.14.d

MAGNETIC LOCK INSERT FOR LOCK MECHANISMS

The invention concerns a magnetic lock insert for the lock mechanisms of openings, which is provided with an internal cylinder fitted with magnetic rotors and a latch rotatable between an opening and a locking position by means of a permanently magnetic key, and with a lock bolt carrier.

The invention is designed to use a single magnetic locking body in locks built into one side only of an opening while for locks built into both sides of an opening axially symmetrically arranged magnetic locking bodies are fixed to each other and surround the lock bolt carrier of the lock mechanism.

The magnetic lock insert of the invention seeks to solve the problem of counteracting attempts at forcibly opening known magnetic locks and significantly modernising and further developing the magnetic cylinder lock disclosed in Hungarian patent specification No. 174,718 (=British Patent No. 2,012,344).

The development and general use of the magnetic locks has been necessitated because they have proved to be more effective in preventing the picking and forcible opening of lock mechanisms than mechanical lock mechanisms. This is explained by the fact that a magnetic lock mechanism makes the use of any foreign key impossible since the locking is not mechanically controlled, rather it is based on the interaction of magnetic fields. Consequently, attempts at cunning, traceless picking of magnetic locks fail. Accordingly, technical developments have to be aimed at reducing or excluding the number of destructive break-in methods, drilling of the lock and other forcible opening possibilities.

Several patent specifications relating to constructional embodiments of magnetic cylinder locks have been published. However, owing to the manufacturing complexity of the mechanisms, and to related technological difficulties, essentially constructions of only two patents have been realised and marketed. One of these is according to the above-mentioned British patent No. 2012344 owned by Elzett Muvek.

Our tests and researches have indicated that within the forseeable future the magnetic lock according to British patent No. 2,012,344 will no longer afford maximal security against break-in methods already known at present and anticipated in the near future. The accelerating rate of development of technology and criminal break-in techniques manifest themselves more and more in this field also.

The problem is, in principle, similar with the technical solution described in German published Application No. P 26 25 994 (=U.S. Pat. No. 4,084,416), the mechanism of which is partly mechanical and partly magnetic. It is similar to the solution of the above-mentioned British patent No. 2,012,344 in that it is also opened and locked by means of a permanent magnetic key in cooperation with permanent magnet rotors. The mechanical locking is ensured partly by tumblers, partly by the latch position which is adjustable by notches in the magnetic rotors. Teeth formed on the latches are receivable or accommodatable by the notches in the rotors, reception being achieved by means of the magnetic key. When a foreign key is forcibly used, the reliable operation of this lock may be interrupted and furthermore no reliable and effective protection is afforded against opening of the lock by drilling.

In view of the above, a significant further development of the solution of our said British patent has become necessary to reduce the possibility of the destructive break-in, and to prevent, as far as possible, successful picking of the locks by force.

In practice, extremely large destructive forces can be applied to magnetic locks, possibly leading to their breakage or destruction, by means of fork spanner or pliers of high mechanical advantage, by using alternating forcible rotations.

Another way of forcibly opening magnetic locks is by drilling, as has already been mentioned. Another aim of our invention is to find a more effective protection against the possibility of drilling out the lock.

Lock-picking methods have become known in which a foreign object of very high strength was placed into the key hole and a high turning moment was applied from outside. The delicate mechanism of the lock was destroyed and though it resisted further attempts at turning the cylinder, the lock became inoperative, i.e. was ruined and consequently following the unauthorised intervention, the lock could not be opened with its own key either.

In connection with the application of magnetic locks, there arose an additional demand from users, for instance in the catering industry, hotels, office buildings etc., namely that in addition to individual keys, there should be a master key for opening and locking a group of locks, as well as a so-called general key suitable for opening and locking of all locks.

The magnetic lock according to the invention was developed in light of the above objectives.

In order to prevent the picking or breaking of the lock by force, the magnetic lock according to the invention is constructed in such a way that two opposite cylinders of the lock are interconnected in respect of force transmission, as protection against twisting or breaking.

In the interest of increasing the protection against drilling, not only are thicker steel inserts of higher strength used, but the steel inserts are formed in such a way as to cover the rotor housing of the cylinder on each side, with the protective steel plate serving for protection against drilling. These steel plates protect not only the rotor housing, but also impede the cutting of a thread into the keyhole such threads being then used to pull out the cylinder from the lock body with the aid of the screw effect. In the interest of above-mentioned protection, the lock bolt carrier is formed from two half-pieces which measure alone is sufficient to thwart the pulling out of the cylinder from the lock body. The most delicate part of the mechanism is the rotor housing which as a result of the abovementioned protection (hard metal cover) cannot be drilled from any direction. The protection of the latch that controls the turning of the cylinder against the possibility of drilling, and the non-removability of the cylinder are achieved by the very advantageous solution that the hitherto used locating mechanism and catch mechanism for preventing key removal are integrated, and by their suitable disposition and arrangement unexpected operating advantages have been realised.

In the course of the experiments aimed at preventing the destruction of the lock by attempting to turn the cylinder of the magnetic lock by force, we discovered that the keyhole can be protected and angular displacement of the cylinder can be prevented if the rotation of the cylinder by a foreign object is divided or broken down into two parts with the aid of two control rings. A circular segment-shaped groove is formed in the control rings which on insertion of the proper key allows in the first section to open and close the lock in the conventional manner, and on rotation of the cylinder is effective to ensure that the latches are pressed in along a forced path to the depth of the outer surface of the cylinder. The second section becomes effective when the cylinder is turned with a foreign object. In this case, the control rings rotate together with the cylinder: then the latches are blocked by the wall of the groove formed in the latch body, because they cannot take up their proper positions in the cylinder. In this position, the latches are subjected to shear stress; however, according to our experiments, the magnitude of the shear force required for the deformation and destruction of the latches is a multiple of the shear force than can be brought about through torque exerted with a foreign object made of the currently known hardest material.

In the course of our experiments it was found that the possibility of operating the magnetic lock with a master key or a general key can also be realised in the case of magnetic locks operated wtih any desired number of individual keys. Namely, it was recognised that more than one latch groove can be formed in the rotors of the magnetic lock, and the latch grooves can be arranged on the rotor in any angular position corresponding to any desired divisor angle of 360°. The latch grooves formed on the rotor enable the key and lock system to be realised. One of the latch grooves is formed on the rotor for the individual keys, and the other latch groove for the master or general keys. According to an alternative construction, a combination is also possible where one of the grooves can be used for the general key and the other one for the master and individual keys.

According to one aspect of this invention there is provided a magnetic-type cylinder lock mechanism comprising an internal cylinder rotatable between a locking and an opening position by means of a key that includes magnetic bodies, said cylinder being provided at only one side, or at both sides of an opening such as a door, the cylinder being accommodated in a housing and formed with a keyhole;

said housing containing a plurality of tumblers of varying length radially displaceable into said keyhole, each tumbler having a housing part and a cylinder part slidable between a locked and an open position respectively preventing and permitting rotation of said cylinder;

latch grooves formed on mutually opposite sides of said cylinder; latch elements in said grooves rotatable with the said cylinder; magnetic rotor elements disposed in notches formed in said cylinder and journalled for rotation about their own axes;

latch channels formed in the magnetic rotor elements and disposed along a chord for receiving said latch elements which in their latched or wedged position constitute a means for preventing angular displacement of the cylinder by means of a foreign object;

an orienting element for determining rotatability of the lock and the removal position of the proper key;

and two control rings arranged between the cylinder and the lock housing, each control ring being provided with a latch groove receiving that part of the latch which prevents rotation of the cylinder;

the said chrodally disposed latch channel being capable of receiving the other part of the latch only in a state of magnetic equilibrium determined by the polarisation of the magnetic elements in the proper key and the magnetic elements of the rotor;

the arrangement being such that when a proper key is fitted into the keyhole the latch is disposed partly in the rotor housing and partly in the rotor support and in this position the cylinder is freely rotatable while when the proper key has been removed the latch channel in the housing of the rotor is disposed outside the line of action of the latch and the latch is disposed in the rotor support and in the latch grooves of the control rings and a latch groove for ensuring the locking position of the latches is formed in the lock housing along the line of the latch grooves of the control rings.

Where there are two cylinders, they are preferably interconnected by a respective coupling shaft insertable by any suitable means, each said shaft is arranged for displacement along its longitudinal axis to interconnect the cylinders and the two parts of the bolt carrier via coupling elements engaged in grooves formed in the ends of the cylinders, said bolt carrier securing the ends of cylinders together in a claw-like manner.

There may be a shoulder formed at the side of the two-part bolt carrier which fits into the grooves formed at the ends of cylinders and surrounds the ends of the cylinders.

Preferably, the tumblers also serve as means for preventing the forcible removal of the cylinder.

Guard plates fitted to the end plates of cylinder and to the inlet opening of the keyhole, pins fixing the guard plates and/or a hard metal lock pin fitted into an extension of the lock body, as well as locating pins arranged at the side of keyhole may serve as devices for preventing drilling of the keyhole.

Preferably, the said orienting device for fixing the datum position of the cylinder is formed by a catch or steel ball placed into a notch of the proper key and at the same time serves also to prevent the removal of the proper key in any angularly displaced position of the cylinder.

The cross-section of the latch channel formed in the rotor housing may be rectangular or inwardly taperingly frusto-conical.

According to another aspect of this invention, there is provided a cylinder lock actuatable with magnetic bodies, applicable in lock mechanisms as an insert having a lock body that includes an internal cylinder rotatable between locking and opening positions by means of a key having permanently magnetic portions, the said lock including permanent magnetic rotors co-operable with the magnetic portions of said key; housing elements for said rotors which elements are provided with two latch channels for receiving a ltach, either of the two latch channels may form the latch channel for the individual or master or general key system, and a selection of the angular position between the latch channels the relative positions of the magnetic fields (which are variable) form the variation factors of the key or lock systems, the number of locking possibilities of which runs in the range of several millions.

Preferably, the outline or contour of the complete cylinder lock may be different to adapt to the cylinder bores of the lock bodies and is provided with anticorrosive insulation in the vicinity of the end plates of the cylinder lock.

The main advantages of the magnetic lock according to the invention are as follows:

Picking of such locks with the currently known state-of-the-art devices is prevented by interconnecting the cylinders which are disposed axially symmetrically oppositely to each other, by a connection of such high strength as regards force transmission that it cannot be broken by a forcible rotation of the lock insert.

The protection of the magnetic locks against drilling is improved by using the steel plates that protect against drilling also to protect the keyhole against thread cutting and subsequent removal of the cylinder from the lock with a screw-threaded tool.

The possibility of picking the magnetic lock body by a forcible rotation of the cylinder is prevented or impeded by dividing such rotation into two parts or stages with the aid of two control rings. The mechanism formed with these control rings resists the torque exerted by any foreign object, (as opposed to a proper key), made of the currently known best and strongest material.

A highly significant development of the magnetic lock according to the invention is represented by enabling the magnetic lock of the invention to function with an individual key, a master and/or a general key(s), in accordance with the demands of the various fields of application.

Preferred embodiments of a magnetic lock according to the invention are described below, purely by way of example, with the aid of the accompanying drawings, in which:

FIG. 1 is a partially broken away side elevation of the magnetic lock according to the invention, FIG. 2 is a cross-section taken along the lines A—A in FIG. 1, FIG. 3 is a cross-section taken along the lines B—B in FIG. 1, illustrating location of the cylinder, FIG. 4 is a cross-section taken along the lines B—B in FIG. 1, but showing a variant of FIG. 3 by utilising a ball catch, FIG. 5 is a cross-section taken along the lines A—A in FIG. 1, showing the operative position of the lock, FIG. 6 is a cross-section taken along the lines E—E in FIG. 1, illustrating the locked position, FIG. 7 is a perspective view on an enlarged scale of a locking latch.

Figure 10:
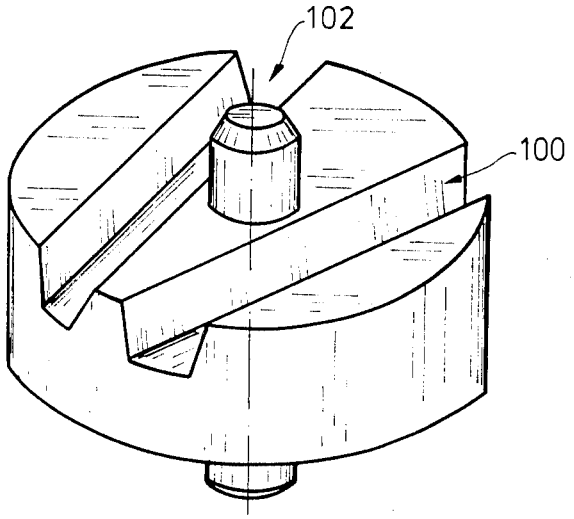
Figure 11:
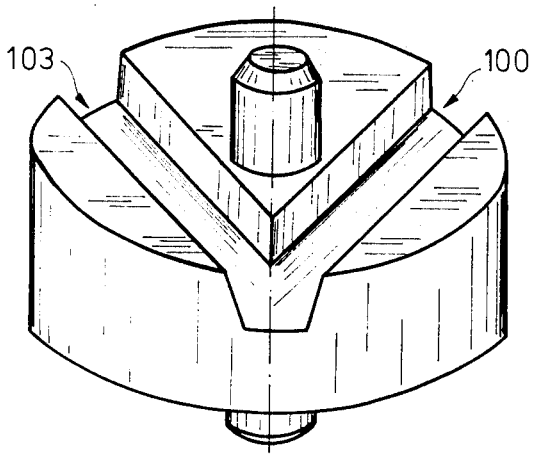
Figure 12:
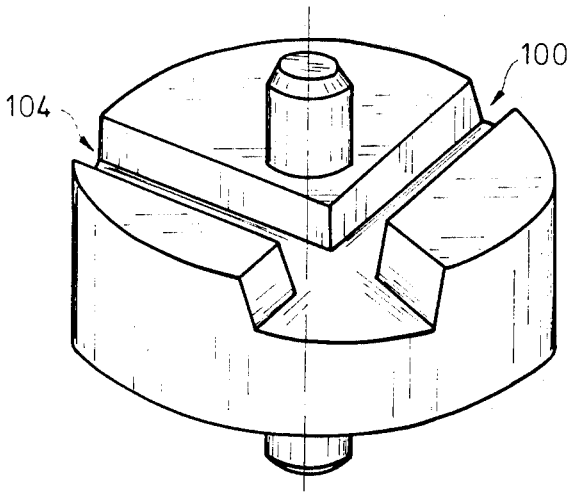
Figure 15:
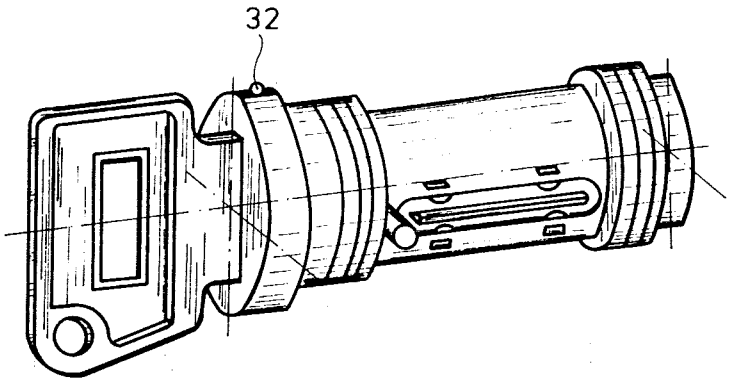

FIGS. 10–12 illustrate, in perspective and on an enlarged scale, variants of rotor housings with two latch channels, FIGS. 13*a*–13*c* are schematic illustrations of possible variants of latch channels formed on the rotors, FIGS. 14, 14*a*–14*d* are schematic illustrations of variants of individual master and general keys given by way of example, with the latch channels of the rotor related to the keys and the configuration or formation of the magnetic positions, and FIG. 15 is an enlarged perspective view of the lock cylinder.

In the lock mechanisms built into one side of the doors only, a single lock body according to the invention is used. Its construction is the same as one-half of the lock consisting of twin lock bodies used in locks built into both sides of doors (openings), as shown in FIGS. 1–9.

The commom characteristics of the magnetic lock according to the invention and the lock according to British patent No. 2 012 344 are the following:

A cylinder 2 arranged in a lock body 1 is turnable with its own key 3. Rotor supports 4 are arranged in recesses formed at both sides of cylinder 2 and are turnable together with the cylinder 2 in the lock body 1. At least two sets or rows of rotors, each set consisting of a rotor 6 containing magnetic rotor bodies 5, are arranged in notch-shaped recesses of rotor supports 4, where the rotors 6 are rotatably journalled on shafts 7. A latch 8 in each rotor support 4 is assembled with the rotors 6 and is wedged or keyed to prevent rotation of the cylinder 2 when such rotation is sought to be effected by a foreign object instead of a proper key. The rotor supports 4 together with rotors 6 are recessed in opposite sides of the outer (mantle) surface of the cylinder 2. The cylinder 2 has a locating bore or pin 31 provided with a catch 30 (FIG. 3) or steel ball 32 (FIG. 4) for assuring rotatability of lock body 1 and the removal or pull-out position of the proper key 3.

In addition to the above-mentioned structural characteristics, the magnetic lock according to the invention is constructed as follows:

FIG. 15 shows that the cylinder 2 of the lock is formed according to the standard dimensions in such a way that it can be inserted into the hole formed for cylinder 2 used for different purposes and dimensions, and thus it is universally applicable. According to the invention, the grooves formed at the two ends of cylinder 2 permit the provision of packing rings so that the cylinder 2 may be protected for instance, against humid, acidic media, i.e. against a chemically aggressive environment, and thus it can function reliably.

Figure 2:
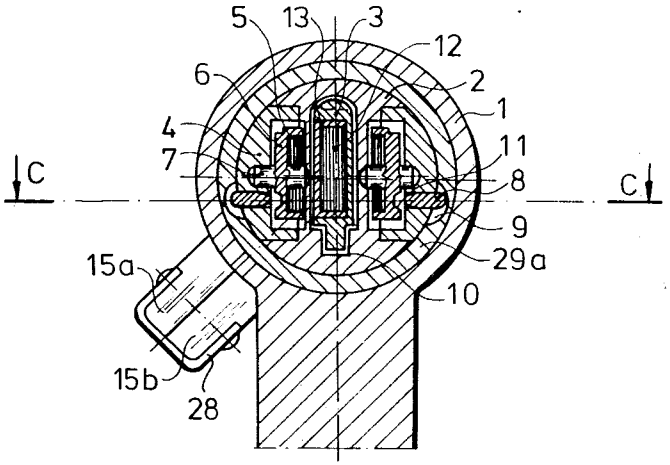
Figure 3:
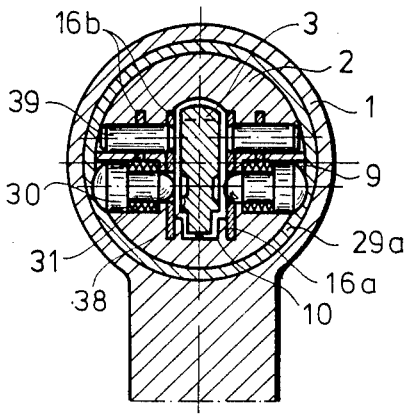
Figure 4:
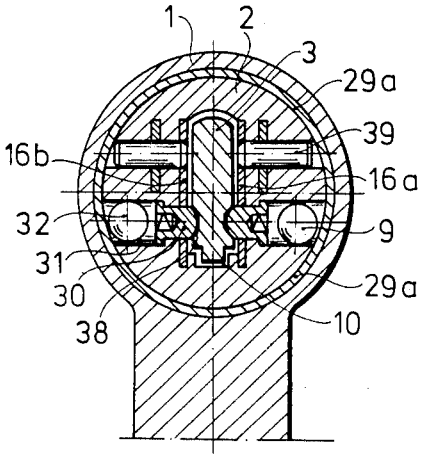

A feature, believed to be novel, of the construction is that two control rings 29*a* and 29*b* are provided between the housing of rotor 6 and the lock body 1. One-half of the height of the latches 8, which serve to fix the cylinder 2 in a locked position without the proper key 3, is arranged in a latch groove 9 formed in the control rings 29*a* and 29*b*, while the other half is arranged in rotor supports 4, see FIGS. 2 or 5. When the cylinder 2 begins to rotate on being turned by its own proper key 3, the housing of the rotor 6 takes up the position corresponding to the position of the magnetic field. In this case the open latch channel 11 formed on the housing of the rotor 6 is positioned along the line of action of the latch 8 (FIG. 2). The position of the magnetic field of the magnetic rotor body 5 may be varied in relation to the latch channel 11 in a previously designed manner.

On further turn of the cylinder 2, the latch groove 9 in the control rings 29*a* and 29*b* forces the latch 8 to be received in the latch channel 11 arranged on the housing of rotor 5. At this stage the latch 8 no longer projects beyond the plane of the outer surface of the cylinder 2, and thus the cylinder 2 can be turned with its own key 3.

Figure 5:
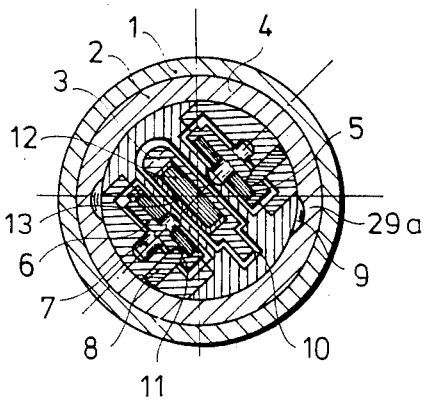

FIG. 5 shows the cylinder 2 angularly displaced, as described in the foregoing.

Figure 6:
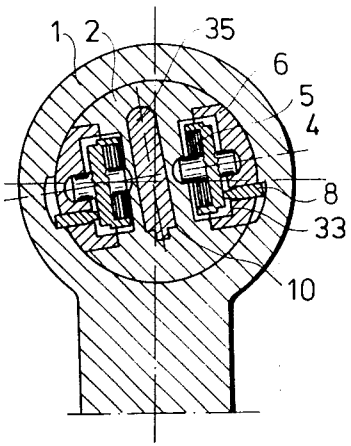

As may be seen well in FIG. 6, when a foreign body differing from the proper key 3 is inserted into the keyhole 10, and an unauthorised lock-opening attempt is made, that attempt cannot succeed. This is because on the initial turn of the cylinder 2, the control rings 29*a* and 29*b* are not displaced because the resistance of the pin 24 co-operating with a ball 18 biased by spring 24 is greater than the force necessary for turning the cylinder 2 (see FIG. 1). In any case, where no magnetic equilibrium is achieved at even only one of the rotors 6, or where the direction of the latch channel does not coincide with the line of action (direction of operation) of the latch 8, the latch channel 11 is incapable of accommodating the latch 8. In such a case, a torque is generated to displace the control rings 29*a* and 29*b* from their positions and to turn them together with the cylinder 2, because the torque is greater than the compressive force of the ball 18 associated with the catch 26. But the extent of the angular displacement is limited, since the latch 8 cannot advance toward the housing of rotor 6, hence one-half of the height or length of the latch 8 projects out from the plane of the outer surface of the cylinder 2. Consequently, the upper half of latch 8 abuts the wall of a latch groove 33 (FIG. 6) formed in the lock body 1, and prevents the cylinder 2 from turning further. In this way, the latches 8 are subjected to shear stress. The force necessary for shearing the latches 8 is, however, a multiple of the force brought about by the torque of the foreign object 35, hence no destruction of the lock will occur.

Thus, the attempt of forcibly turning the cylinder 2 is unsuccessful, the lock mechanism is not deformed and its continuity of operation is uninterrupted.

A forcible attempt at picking the lock presupposes that the tumblers 22 have been removed or otherwise rendered inoperative by means of some foreign body or device since in the contrary case these also would have to be sheared off by the forces which originate from the torque.

The tumblers 22 are of varying effective lengths and are fitted into the cylinder 2. The tumblers 22 assure the turnability of the cylinder 2 by the fact that the steps 21 formed on the key bit have differing depths for equalising the length of the tumblers 22. Thus the tumblers 22 reach the plane of the outer surface of the outer cylinder 2. The tumblers 22 are sprung-loaded or resiliently supported on supports 19*a* and 19*b*.

Another conventional possible form of destructive lock-picking is to drill or bore a thread into the keyhole and then, for instance with a known bearing removal method, an attempt is made to pull the cylinder out of the lock insert and then by means of an auxiliary device, the lock mechanism is interfered with.

Figure 8:
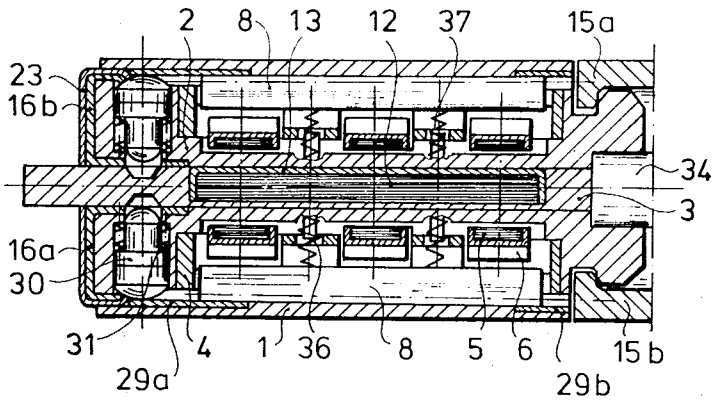
FIG. 8 is a cross-section taken along the lines C—C in FIG. 2.
Figure 9:
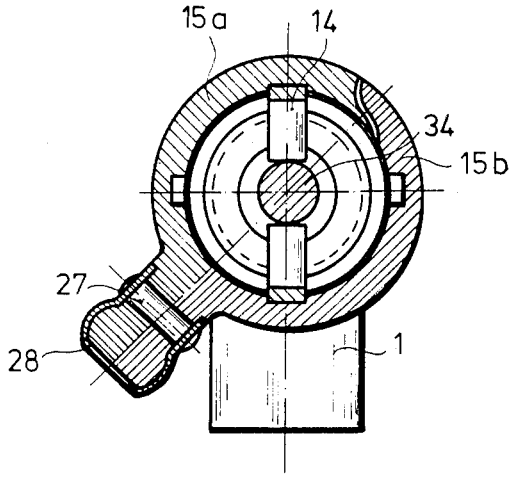
FIG. 9 is a cross-section taken along the lines D—D in FIG. 1.

In the construction of the lock according to the invention, it is not possible to drill or bore into the keyhole 10 because the hardness of the material of the protective plates 16*a* and 16*b* prevent this (see FIG. 8). However, the primary protection of the keyhole 10 against drilling is assured by an insert 23 made of hard steel and fitted to the front face of the lock body 1.

The interconnecting means of the two cylinders 2 of the magnetic lock according to the invention (the inner cylinder within the door and the outer cylinder) is constituted by a connecting shaft 34 which is displaceable in the direction of its longitudinal axis by the inserted proper key 3. Coupling elements 14 fixed to the shaft 34 connect the ends of the cylinder 2 with the two part lock bolt carrier 15*a*, 15*b* via grooves formed in the lock bolt carrier 15*a*, 15*b* which is the actuating device of the latch. The lock bolt carrier parts 15*a*, 15*b* are held together by a hard metal plate cover 28 and fixed with rivets 27. The lock bolt carriers 15*a* and 15*b* hold the end parts of cylinders 2 in a claw-like manner.

Figure 1:
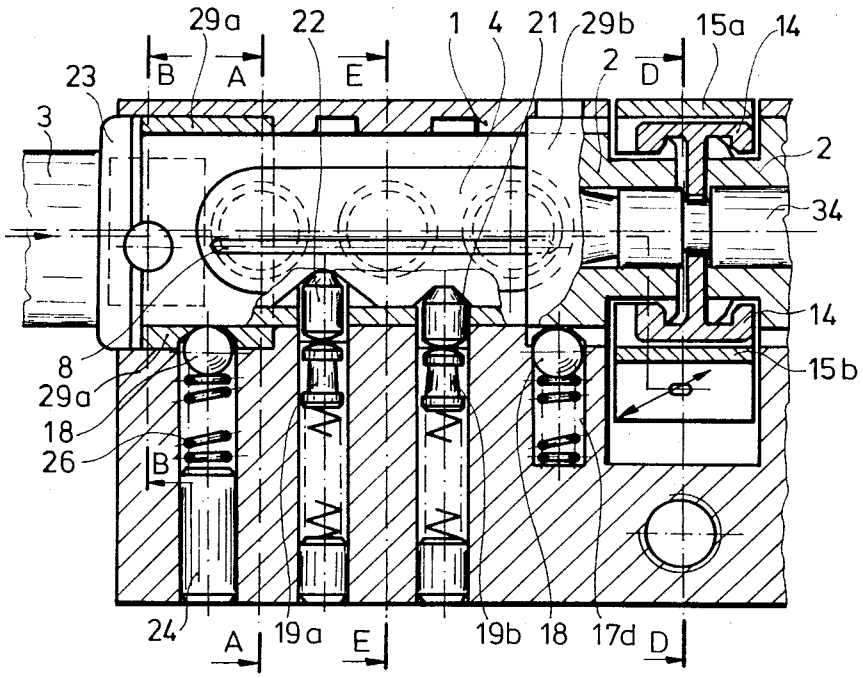

The two cylinders 2, namely the inner cylinder within the door and the outer cylinder, are interconnected by the coupling shaft 34 which fits into bores at the ends of cylinder 2, relieves the cross-section, critical from the viewpoint of breakage, between the cylinders 2 against possible external torsional forces, and resists attempts to pick. Another role of the coupling shaft 34 is to guide a proper key into the other cylinder 2 on its insertion into the keyhole 10 and then to entrain the engaging or coupling elements 14 by means of the key 3 which interconnect the two cylinders 2 with the lock bolt carriers 15*a* and 15*b*, via the grooves formed in the lock bolt carriers 15*a*, 15*b* at the ends of cylinders 2. Actuation of the proper key 3 and of the latch in the lock housing takes place through this mechanical connection, which is illustrated in FIG. 1 by a thick kinetic dash-and-dot line of action. A notch or nest 38 is formed on the proper key 3, the depth of which corresponds to the depth of latch groove 9 in the control rings 29*a*, 29*b*; it serves for receiving the locating catch projecting into the cylinder 2 in its turned position and also for securing the key 3.

The proper key 3 is not removable from the keyhole 10 after the cylinder has been turned, this being prevented by the cylinder-locating catch 30 or by the compression spring 31 pressing the steel ball 32 because the key 3 is positioned in the notch 38, and thereby the removability of the proper key 3 from the keyhole 10 is hindered. On turning the cylinder 2, either the catch 30 (in first embodiment according to FIG. 3) or steel ball 32 (in the second embodiment according to FIG. 4) comes to lie below the plane of the outer surface of the cylinder 2 opposite the line of action of the compression spring 31, whereby the cylinder 2 becomes turnable. In this case, removal of the proper key is not possible because the catch 30 or steel ball 32 is wedged into the notch 38 of the key 3.

Thus the catch 30 or steel ball 32 constitutes the device for accurately positioning or locating the cylinder 2 and for promoting the unhindered angular displacement of the rotors 6.

Furthermore, the catch 30 or steel ball 32 allows the removal of the proper key 3 only in the so-called 0° or datum position.

The catch 30 or steel ball 32 arranged at both sides of the lock body 1 constitutes a device that impedes any attempt at drilling and progress of the drilling.

Figure 7:
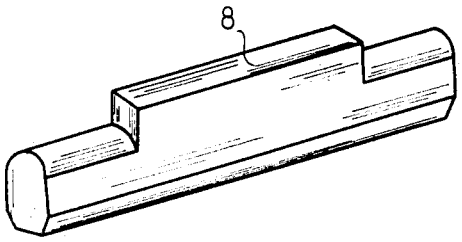

The ends of latch 8 are stepped with its central part projecting out, see FIG. 7. This central part is in contact with the latch groove 33 in the lock body 1, while the stepped ends of latch 8 are guided on the control rings 29*a* and 29*b* and on the rotor support 4.

The guard plates 16*a*, 16*b* for protecting the keyhole 10 against drilling are made of hard steel; their fixing elements are formed by catches 30 arranged at the sides of the keyway 10. The catches 30 are also made of hard steel; again, for impeding the drilling. Likewise, for the purpose of protection against drilling, hard steel guard plates 16*a* and 16*b* are arranged at the end face of cylinder 2 and at the inlet of the keyhole as well as pins 39 for fixing the guard plates 16*a*, 16*b* and/or a hard metal lock pin 24 fitted into the extension of lock body 1; furthermore, there are catches 30 at the side of the keyhole.

In the preferred embodiment according to the invention, cutting a thread into the keyhole 10 is prevented by the hardness of the guard plates 16*a*, 16*b*. In order to prevent the destructive removal of the guard plates 16*a*, 16*b* and to prevent drilling, the locating catches 30 arranged at the sides of the keyhole 10 are also made of hard steel, as has already been mentioned. (These locating catches 30 fit into the notch 38 of the proper key 3).

However, the primary protection of the keyhole 10 against drilling is afforded by the hard steel insert 23 on the end face of the lock body 1.

Pulling out the cylinders 2 with a foreign object is prevented also by the tumblers 22 that block the cylinder 2. For further safety, the cylinders 2 are fixed in the lock body 1 so that the two-part lock bolt carrier 15*a*, 15*b* embraces the cylinders 2 like a claw (FIG. 1).

The possibility of the production of master keys and general keys and the magnitude of the number of variations all play a prominent part for lock mechanisms. This invention has made a significant advance in this field also. Not only is the number of proper keys increased, but the latch channels 11 of the balanced housings of rotors 6 afford the possibility for the construction of reliably operable lock systems with a very large number of variants.

The aim of developing magnetic locks is not only increased security mainly against destructive breaking in methods, but also extends the use of the latch unit within given lock systems.

Modern lock manufacture is predicated on a mass production of an ever-increasing number of group keys, master keys and general keys, as well as central lock systems with the required degree of security and reliability.

It is self-evident that for many fields of application, e.g. hotels, public buildings etc. it is extremely convenient to be able to use a single master or general key for opening individual locks, instead of using a bunch of keys. Such a key is to be capable of opening and locking all locks operable with individual keys. Earlier, it became evident that a lock that was locked with two different keys, e.g. with its own proper key and a master key, is not as secure—in the case of a group of master keys consisting of several "member" keys—as one made only for its own key.

The locks of magnetic system according to the invention eliminate or reduce this drawback of mechanical locks and at the same time satisfy security demands and requirements.

One embodiment of a lock system according to the invention provided with a master or general key is described with the aid of FIGS. 10–12, which illustrate binary rotor housing, on which two latch channels are formed so that one of the latch channels is used for the system of the proper, i.e. individual keys, while the other latch channel for the system of the master or general keys.

The lock systems can be separated from each other by setting the normal or datum position of the magnetisation in different angular positions in the co-ordinate system and thus no symmetrical rotor can exist in the set of rotors.

From the combination of the number of latch channels and magnetic positions, a general key system of significant size is formed. In addition, the unusually large number of variations required in the lock industry is extended even more with the use of tumblers 21, 22 of differing lengths, as well as on the basis of the number and dimension of the different shoulders of the keyholes 10.

A lock system model can be built according to the example of lock channels 100, 102, in FIG. 10; 100, 103 in FIG. 11; and 100, 104 in FIG. 14 and thus the number of combinations can be increased by variation of the position of the latch channels 100–104, and by rotating the selected division of the magnetic field in the co-ordinate system.

Let us assume that the key is one-sided and has three magnetic positions (FIG. 14). Only some of the possibilities of the rotor set shown by way of example are represented in FIGS. 13*a*—13*c*, which clearly demonstrate that the lock system can be realised with a large number of sub-group members based on the elements of the general key system. In the model, the channel of the first number at the rotors represents the basis of the general key, and the second number designates the system of the master and proper own keys.

Summing up, the rotor 6 according to the invention can be formed with more than one latch channel 100–104, of which one, e.g. the latch channel 100, is used for the individual key 3, a second latch channel 102, 103 or 104 for the master or general key. The latch channel 100 may be used simultaneously for the individual key 3 and a master key too, while the further latch channels 101–104 may be used for the general key or further keys. The latch channels 100–104 can be formed by dividing the 360° field in any desired manner. The direction of magnetisation of the magnetic body 5 of the rotors 6 in relation to the direction of latch channels 100–104 can be selected by dividing the 360° field in any desired manner.

In this way, the actual angular positions of the latch channels 100–104 and the magnets of the rotor magnetic bodies 5 determine the number of variations of the lock system, bearing in mind that the direction of magnetisation of the magnetic bodies 5 assigned to the individual latch channel 100 of the rotor 6; while the direction of magnetisation of magnets 12 in the master or general key coincides with the direction of magnetisation of the magnetic bodies 5 assigned to the latch channels 102–104 of the rotor 6.

In addition the number of variations of the lock system according to the invention may be increased by increasing the number of latch channels 100–104, and/or by angularly displacing the datum position of the magnetic fields, or by increasing the dividing ratio of the magnetic fields.

FIG. 13*a* shows the proper or individual keyways of the basic rotors I–VI, and their directions of magnetisation.

The rotors shown in FIG. 13*b* were made with the combination of rotors I–VI, so that the first row of rotors denoted with the Roman number X in FIG. 13*b* is for use with the individual keys associated with rotor I, for example rotor XII for the general key according to rotor I in FIG. 13*a*, and the second row of rotors denoted with the Roman number XX.. is for use with the individual key according to basic rotor II, e.g. XXIII for rotor II and so on.

A table of the rotor series that may be formed as described above is shown in FIG. 13*c*.

FIGS. 14*a* to 14*d* show the formation of rotors according to FIGS. 13*a*–13*c* including the position of the magnetic fields of the keys assigned to them, FIG. 14*a* being for a master key, FIG. 14*b* for main keys and FIGS. 14*c* and 14*d* for individual keys.

We claim:

1. A magnetic-type cylinder lock mechanism comprising an internal cylinder rotatable between a locking and an opening position by means of a key that includes magnetic bodies, said cylinder being provided at only one side, or at both sides of an opening such as a door, the cylinder being accommodated in a housing and formed with a keyhole;

said housing containing a plurality of tumblers of varying length radially displaceable into said keyhole, each tumbler having a housing part and a cylinder part slidable between a locked and an open position respectively preventing and permitting rotation of said cylinder;

latch grooves formed on mutually opposite sides of said cylinder; latch elements in said grooves rotatable with the said cylinder; magnetic rotor elements disposed in notches formed in said cylinder and journalled for rotation about their own axes;

latch channels formed in the magnetic rotor elements and disposed along a chord for receiving said latch elements which in their latched or wedged position constitute a means for preventing angular displacement of the cylinder by means of a foreign object;

an orienting element for determining rotatability of the lock and the removal position of the proper key;

and two control rings arranged between the cylinder and the lock housing, each control ring being provided with a latch groove receiving that part of the latch which prevents rotation of the cylinder;

the said chordally disposed latch channel being capable of receiving the other part of the latch only in a state of magnetic equilibrium determined by the polarisation of the magnetic elements in the proper key and the magnetic elements of the rotor;

the arrangement being such that when a proper key is fitted into the keyhole the latch is disposed partly in the rotor housing and partly in the rotor support and in this position the cylinder is freely rotatable while when the proper key has been removed the latch channel in the housing of the rotor is disposed outside the line of action of the latch and the latch is disposed in the rotor support and in the latch grooves of the control rings and a latch groove for ensuring the locking position of the latches is formed in the lock housing along the line of the latch grooves of the control rings.

2. A mechanism as claimed in claim 1, wherein in the case of there being two cylinders, they are preferably interconnected by a respective coupling shaft insertable by any suitable means, each said shaft is arranged for displacement along its longitudinal axis to interconnect the cylinders and the two parts of the bolt carrier via coupling elements engaged in grooves formed in the ends of the cylinders, said bolt carrier securing the ends of cylinders together in a claw-like manner.

3. A mechanism as claimed in claim 1, wherein a shoulder formed at the side of the two-part bolt carrier fits into the grooves formed at the ends of cylinders and surrounds the ends of the cylinders.

4. A mechanism as claimed in claim 1, wherein the tumblers also serve as means for preventing the forcible removal of the cylinder.

5. A mechanism as claimed in claim 1, wherein guard plates fitted to the end plates of cylinder and to the inlet opening of the keyhole, pins fixing the guard plates and/or a hard metal lock pin fitted into an extension of the lock body, as well as locating pins arranged at the side of keyhole serve as devices for preventing drilling of the keyhole.

6. A mechanism as claimed in claim 1, wherein the said orienting device for fixing the datum position of the cylinder is formed by a catch or steel ball placed into a notch of the proper key and at the same time serves also to prevent the removal of the proper key in any angularly displaced position of the cylinder.

7. A mechanism as claimed in claim 1, wherein the cross-section of the latch channel formed in the rotor housing is rectangular or inwardly taperingly frustoconical.

* * * * *